United States Patent [19]

Stansbury, Jr. et al.

[11] 4,333,383

[45] Jun. 8, 1982

[54] PRIMER DEVICE

[75] Inventors: LeRoy Stansbury, Jr.; William F. Donovan, both of Aberdeen, Md.

[73] Assignee: The United States of America as represented by the Secretary of the Army, Washington, D.C.

[21] Appl. No.: 89,020

[22] Filed: Oct. 29, 1979

[51] Int. Cl.[3] ..... F41F 1/04

[52] U.S. Cl. ..... 89/7

[58] Field of Search ..... 102/200, 202, 204, 275, 102/275.11, 289; 89/7, 8

[56] References Cited

U.S. PATENT DOCUMENTS

| | | | |
|---|---|---|---|
| 3,311,020 | 3/1967 | Piacesi et al. | 89/8 |
| 3,326,084 | 6/1967 | Barbieri et al. | 89/7 |
| 4,029,017 | 6/1977 | Hübsch et al. | 102/202 |
| 4,050,349 | 9/1977 | Graham | 89/7 |
| 4,132,149 | 1/1979 | Ashley | 89/7 X |

*Primary Examiner*—David H. Brown

*Attorney, Agent, or Firm*—Nathan Edelberg; Robert P. Gibson; A. Victor Erkkila

[57] ABSTRACT

A primer device has a coupling device for efficiently dispersing the ignition products from a primary propellant into a main charge. The coupling device has a housing with a central chamber. This chamber has an inlet and outlet port. The housing and its inlet port are sealed over a cavity containing a primary propellant. A valve device is mounted at the inlet port for initially sealing combustion gasses from the primary propellant within the cavity. This initial interval during which the cavity is sealed, fosters thorough burning of the primary propellant. When combustion causes pressure sufficient to open the valve device, combustion products enter the central chamber of the housing. These combustion products bear upon a frangible seal, which is mounted at the outlet port of the housing. The frangible seal ruptures at a predetermined and repeatable pressure. As a result, the combustion gasses from the primary propellant are expelled from the housing at a high pressure and at a time when a great percentage of the primary propellant has been burned. As a result an energetic flame exits from the housing, efficiently and thoroughly igniting the main charge.

14 Claims, 4 Drawing Figures

PRIMER DEVICE

GOVERNMENT INTEREST

The invention described herein may be manufactured, used and licensed by or for the government for governmental purposes without the payment to us of any royalties thereon.

BACKGROUND OF THE INVENTION

The present invention relates to primers and in particular to primers employing a pair of pressure responsive devices.

In firing a weapon, usually a primer employing a primary propellant is initially ignited which in turn ignites a main charge. A primer is designed to be conveniently ignited by percussion or electrical ignition to produce an intensely hot expanding gas which efficiently ignites a main charge. Numerous types of primers are known, such as spark igniters, hypergolic igniters, bayonet primers, ball head primers etc.

If the main charge is a liquid propellant, it is important to isolate this liquid propellant so it does not wet the primary propellant. Such isolation is important because an intimate contact between the two propellants results in poor ignition. Poor ignition generally happens if the liquid propellant enters the primer since ignition must now commence over the relatively confined area within the primer.

A known primer houses the primary propellant and separates it from the main charge. This primer retains the primary propellant in a cylindrical cavity which is covered by a cylindrical piston. The primer has a plurality of radial orifices which are initially sealed by the piston before firing. Upon ignition of the primary propellant its expanding combustion gasses drive the piston away from the orifices thus allowing emission of the cumbustion gasses of the primary propellant through the orifices to ignite the main charge. A disadvantage with this piston arrangement is that the combustion gasses of the primary propellant are ejected almost immediately and at a moderately low pressure. As a result the flames from the primer are emitted somewhat randomly and at a pressure which is not especially conducive to efficient ignition of the main charge.

The present invention avoids such problems and provides unique advantages by employing a housing having a frangible seal upstream and a valve means downstream. As a result the primary propellant is contained for a brief interval by the valve means to allow fuller combustion. Upon reaching a predetermined pressure the combustion gasses of the primary propellant are released and bear upon the frangible seal. This frangible seal provides several functions. For the case where the main charge is a liquid propellant the seal prevents the liquid from flowing into the housing, thereby insuring that main charge is not ignited within the relatively confined area within the housing. Moreover, isolating the liquid propellant from the interior of the housing prevents the build-up of high pressure gasses that can unduly stress the housing. This latter feature is important for embodiments wherein the housing is reusable. Importantly, the frangible seal provides a high pressure restraining device which allows the primary propellant to rise to a relatively high and accurately repeatable pressure before the primary propellant is released to the main charge. This last feature insures an energetic expulsion of hot, highly pressured combustion gasses which efficiently and energetically ignite the main charge.

Accordingly, by employing such apparatus a main charge can be ignited without using erodable electrodes that require significant electrical energy. Furthermore, because a frangible seal is used, a high degree of isolation is achieved which avoids gaseous venting into a liquid propellant. Moreover, toxic chemicals such as hydrochloric acid are not required as with hypergolic ignition.

Another significant advantage is that the action of the primer is reproducible. This feature is important since projectiles must be consistently launched without significant variations in their range. Of course, any inconsistencies in muzzle velocity caused by inconsistencies in the primer, result in firing inaccuracies. Since the pressure at which the primer operates is reproducible and accurate, the rate of heat transfer to the liquid propellant is also accurate and reproducible. Such kinetics can be thus controlled and can be simulated by computer.

SUMMARY OF THE INVENTION

In accordance with the illustrative embodiment demonstrating features and advantages of the present invention there is provided in a primer device a coupling means for igniting a main charge. The primer device includes a primary propellant contained in a cavity of a breech body. The coupling means includes a housing, a valve means and a frangible seal. The housing has a central chamber and the chamber has an inlet and an outlet port. The housing and its inlet port are sealingly mountable over the cavity in the breech body. The outlet port is adjacent to the main charge. The valve means is mounted at the inlet port for sealing the cavity from the chamber. The valve means is operable to allow communication between the cavity and the chamber in response to the pressure in the cavity exceeding that of the chamber by a given valve pressure. The frangible seal is mounted at the outlet port for sealing it. This seal is sized to rupture in response to a predetermined differential pressure across it.

BRIEF DESCRIPTION OF THE DRAWINGS

The above brief description as well as other objects, features and advantages of the present invention will be more fully appreciated by reference to the following detailed description of a presently preferred but nonetheless illustrative embodiment in accordance with the present invention when taken in conjunction with the accompanying drawings wherein.

DETAILED DESCRIPTION OF THE PREFERRED EMBODIMENTS

Figure 1:
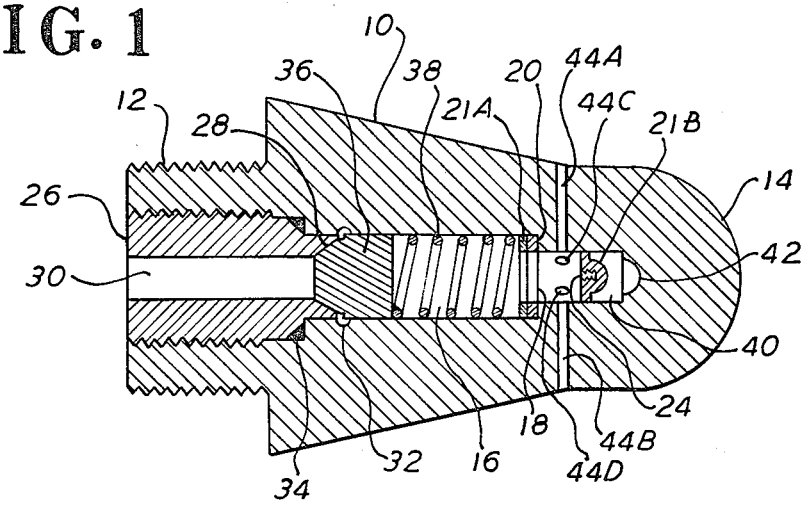
FIG. 1 is a sectional view of a coupling means in accordance with the present invention.

Referring to FIG. 1, a coupling means is shown comprising a housing, shown herein as main frame 10 shaped as a tapered solid of revolution having threaded neck 12 of a reduced diameter. Frame 10 is essentially a cylindrical threaded section 12, contiguous to a central frustro-conical section that is capped by rounded section 14. The shape of housing 10 is designed to distribute stresses within the housing and thus avoid its failure. Other shapes however, will be apparent to those skilled in the art. Frame 10 has contained within it a central cylindrical chamber 16. The forward face of chamber 16 ends in outlet port 18. Sealed to outlet port 18 by means of washer 20 is a frangible seal, shown fragmented into two pieces: retained fragment 21*a* and expelled fragment 21*b* (collectively identified herein as seal 21). In this embodiment frangible seal 21 is fabricated from Nylatron, which is nylon impregnated with molybdenum. Frangible seal 21 is shaped as a cylindrical disc having its forward face capped with a solid dome. This solid dome, shown in fragment 21*b*, contains a threaded, blind hole 24 which opens to the flat side of seal 21.

Threaded into the aft face of housing 10 is annular insert 26. Insert 26 includes an inlet passage 30 which terminates at its inlet port 28, which has a frustro-conical shape. Contiguous to inlet port 28 is annular recess 32 which is formed as a rounded groove in the aft sidewall of chamber 16. Insert 26 is sealed to main frame 10 by means of wedge gasket 34.

Port 28 is sealed by a valve means shown herein as valve member 36 and a yieldable means shown herein as helical compression spring 38. Valve member 36 is essentially a fluted metal member capped by a frustroconical portion which mates with valve seat 28. Compression spring 38 expands against valve member 36 and frangible seal 21 to seal them to valve seat 28 and outlet port 18, respectively. Contiguous to outlet port 18 is receptacle 40. Receptacle 40 is essentially a cylindrical bore that is coaxial to central chamber 16. The forward end of receptacle 40 terminates in hemispherical cavity 42. Cavity 42 has a radius of curvature exceeding that of the domed portion frangible seal 21.

Communicating with receptacle 40 and thus port 18 are a plurality of lateral orifices. Six radial orifices are employed in this embodiment, two orifices 44*a* and 44*b* being shown in section, the inward end of two others being shown as inlets 44*c* and 44*d*. The two other orifices are not shown but are symmetrically located opposite inlets 44*c* and 44*d*. It is apparent that different numbers of lateral orifices may be used depending upon the volume to be emitted and how finely it is to be divided. In the presently illustrated embodiment, orifices 44*a*, 44*b*, 44*c* and 44*d* (hereinafter orifices 44) are uniformly distributed and lie along radial projections that are orthoginal to the axis of main frame 10. It is anticipated, however, in other embodiments the orifices will be forwardly tilted in order to expel combustion gasses with a forward component of velocity. It is anticipated that such forwardly tilted orifices will be uniformly distributed as conical elements. For other embodiments it is anticipated that the orifices will be skewed so that expelled combustion gasses will have a tangential component of velocity. In fact it is anticipated that for some embodiments orifices will intercept the sidewall of receptacle 10 tangentially. In one embodiment the differential pressure at which seal 21, by design, ruptures is 14000 pounds per square inch. In this embodiment spring 38 was chosen to seal port 28 until the differential pressure across valve member 36 exceeded approximately 113 pounds per square inch. Of course, the specific pressure at which these devices operate is a designer's choice and is chosen to facilitate combustion of the specific propellants which are to be burned.

Figure 2:
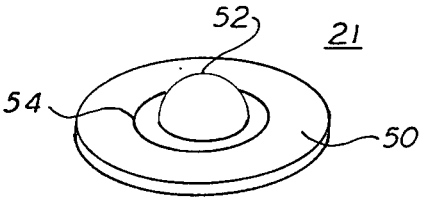
FIG. 2 is an isometric view of the frangible seal previously illustrated in FIG. 1.

Referring now to FIG. 2, an isometric view of previously illustrated frangible seal 21 is given in detail. Seal 21 is shown in its unruptured condition. Essentially seal 21 comprises a flat cylindrical disc portion 50 and a concentric domed portion 52. Domed portion 52 in this embodiment is a solid hemisphere which has a blind hole (previously illustrated) through its flat side. The position at which seal 21 ruptures is determined by a circular concentric score 54 which surrounds domed portion 52. The diameter of score 54 is chosen to allow the central fragment to pass unimpeded through receptacle 40 (previously illustrated in FIG. 1).

Figure 3:
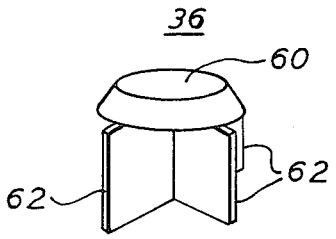
FIG. 3 is an isometric view of a valve device previously illustrated in FIG. 1.

Referring to FIG. 3, valve member 36, which was previously illustrated in FIG. 1, is shown herein in isometric view. Valve member 36 comprises a frustroconical cap 60 which seats with the valve seat 28 (previously illustrated in FIG. 1). Cap 60 is affixed to a larger fluted column, shown herein as a four-spoked, paddle wheel arrangement 62. The fluting of arrangement 62 is required to allow combustion gasses to pass by valve member 36, even though the side ends of fluted column 62 touch the inside of the chamber in which it is mounted.

Figure 4:
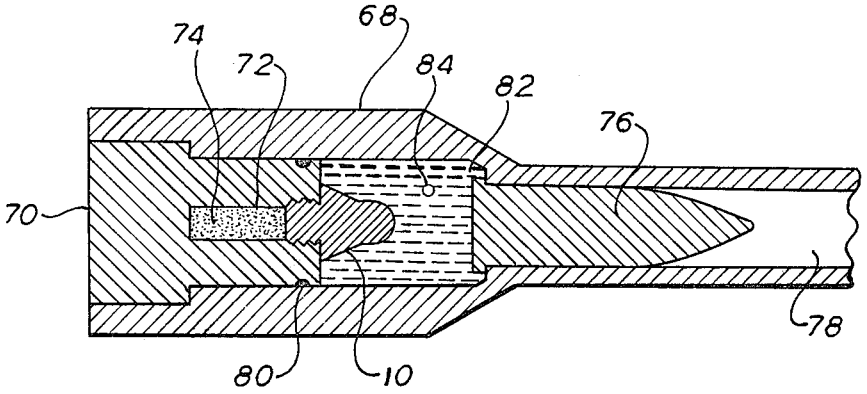
FIG. 4 is a sectional view showing the device of FIG. 1 mounted on a breech body and loaded together with a projectile into a barrel.

Referring to FIG. 4, the apparatus of FIG. 1 is shown installed in a gun barrel 68. Previously described main housing 10 (FIG. 1) is shown in this simplified sectional view, threaded into a breech body 70 which has a cavity 72 filled with primary propellant 74. Projectile 76 is shown mounted in the bore 78 in front of breech body 70. Breech body 70 is held in the breech of barrel 68 in a conventional manner and is sealed thereto by annular seal 80.

Barrel 68 includes a conventional means for filling interspace 82 between projectile 76 and body 70 with liquid propellant. Liquid propellant is piped into interspace 82 through inlet 84. A corresponding vent (not shown) is used to allow air displaced by incoming liquid propellant to escape. The inlets and vents just described are connected to conventional high pressure valves and pipes (not shown).

To facilitate an understanding of the foregoing apparatus its operation will be briefly described. After this apparatus is assembled and loaded into barrel 68 as shown in FIG. 4, liquid propellant is piped in through inlet 84 to fill interspace 82, while displaced air is simultaneously vented. Once interspace 82 has been filled, the inlets and vents to interspace 82 are sealed. Primary propellant 74 is now ignited by percussion or by an electrical spark system (not shown). Accordingly, solid propellant 74 burns within cavity 72 until it reaches a pressure of approximately 113 pounds per square inch. This interval during which pressure rises is significant since it allows the primary propellant sufficient time to ignite successfully and to produce a vigorous flame. The pressure produced by propellant 74 (FIG. 4) is communicated through passage 30 (FIG. 1) and is brought to bear on valve member 36. Valve member 36 is initially sealed against valve seat 28 by means of compression spring 38 so that combustion gas does not flow into chamber 16. When the pressure in passageway 30 exceeds the above mentioned 113 pounds per square inch, valve member 36 retracts, compressing spring 38 and allowing combustion gas to flow past valve member 36 through annular recess 32 and through the spokes 62 (FIG. 3) of valve member 36. The annular recess 32 (FIG. 1) insures that the combustion gasses flowing around valve member 36 are not unnecessarily constricted. Such constriction can cause the combustion gasses to accelerate. This acceleration would tend to be an irreversible process resulting in non-isentropic flow. Accordingly, energy would be wasted in such a process and would not be available to ignite the liquid propellant. As combustion gasses enter chamber 16 its internal pressure rapidly rises and bears against frangible seal 21 (FIG. 1). When the pressure reaches a predetermined magnitude (in this embodiment 14000 pounds per square inch) the frangible seal ruptures around score 54 (FIG. 2). Accordingly, fragment 21*b* (FIG. 1) is expelled through receptacle 40 and is driven into abutment with cavity 42. Cavity 42, having a larger radius of curvature than the domed portion of fragment 21*b*, does not cause fragment 21*b* to become wedged. It is important to note that liquid propellant does not enter chamber 16 and does not mix with the primary propellant 72 (FIG. 4). This feature is important since it avoids wetting the primary propellant 72 with liquid propellant. Wetting of the primary propellant 74 would cause the flames of the primary propellant to operate in the relatively confined area within chamber 72. Such condition would be undesirable since the flames of the liquid propellant would be emitted from orifices 44 (FIG. 1) instead of the hotter, more vigorous flame of the primary propellant 74 (FIG. 4).

Accordingly, upon the rupture of frangible seal 21 the hot combustion gasses produced by primary propellant 74 (FIG. 4) rush through passageway 30 (FIG. 1) through central chamber 16 and out of orifices 44. These hot outrushing combustion gasses contact the main charge as they leave orifices 44. Therefore the relatively hot flames produced by primary propellant 74 (FIG. 4) are uniformly dispersed over a relatively large area at the perimeter of main frame 10 (FIGS. 1 and 4). These well-developed flames are ejected at relatively high pressure and immediately cause ignition over a large portion of the liquid propellant within interspace 82. Consequently, ignition of liquid propellant proceeds rapidly and a pressure wave propagates and reflects through interspace 82. Eventually the pressure within interspace 82 rises sufficiently to tend to induce a back flow through orifices 44. Such back flow is undesirable since it only results in an overall reduction in pressure within interspace 82. However, valve member 36, being essentially a check valve, responds to this tendency toward back flow by returning to its sealed position. Therefore the combustion of the main charge occurring within interspace 82 is contained and isolated from cavity 72. As a result, pressure violently and rapidly increases and bears against the aft end of projectile 76. Accordingly, projectile 76 is fired through bore 78.

It is anticipated for some embodiments that except for the fired projectile and the consumed propellants, the apparatus of FIG. 4 will be reused. Therefore, after firing, breech body 70 is removed from barrel 68 and main frame 10 is unthreaded from body 70. In this condition cavity 72 is readily refilled with primary propellant. Next annular liner 26 is unthreaded from main frame 10 and valve member 36 and spring 38 are withdrawn. Also, seal fragments 21*a* and 20 are discarded. Seal fragment 21*b* which was driven against cavity 42 is readily removed by inserting a threaded rod through passageway 30. The threaded rod is threaded into blind hole 24 so that fragment 21*b* is easily removed. Main frame 10 is reassembled by inserting another gasket 20 and seal 21. Spring 38 and valve member 36 are reinserted into chamber 16 as shown in FIG. 1. All of these members are held in place by rethreading liner 26 into the aft face of main frame 10. Thus assembled, the device of FIG. 1 has been restored to the condition previously existing prior to the last mentioned firing. The apparatus of FIG. 1 is now rethreaded into breech body 70 to seal the primary propellant within cavity 72. Next, the barrel 68 is loaded with another projectile such as projectile 76 (FIG. 4) Breech body 70 and its attached frame 10 (FIG. 4) is then reloaded into the breech of barrel 68 and sealed thereto in a conventional manner. Thus reloaded, interspace 82 of barrel 68 may again be refilled and sealed with liquid propellant (FIG. 4). The weapon may then be again fired in the manner previously described.

It is appreciated that modifications and alterations can be implemented with respect to the apparatus just described. For example, various frangible seals having different shapes and different rupture pressures, can be employed. In addition, various valves can be used having different shapes and actuating pressures. Furthermore, various materials such as metals, plastics and other suitable materials can be employed to provide the desired strength, wear, capacity etc.

Obviously many other modifications and variations of the present invention are possible in light of the above teachings. It is therefore to be understood that within the scope of the appended claims, the invention may be practiced otherwise than as specifically described.

We claim:

1. In a primer device having a primary propellant contained in a cavity of a breech body, a coupling means for igniting a main charge, comprising:

a housing having a central chamber, said chamber having an inlet and outlet port, said housing and its inlet port being sealingly mountable over said cavity, said outlet port being adjacent to said main charge;

a valve means mounted to said inlet port for sealing said cavity from said chamber, said valve means being operable to allow communication between said cavity and chamber in response to the pressure in said cavity exceeding that of said chamber by a given value pressure; and a frangible seal mounted at said outlet port for sealing it, said seal being sized to rupture in response to a predetermined differential pressure across it.

2. In a primer device according to claim 1, wherein said outlet port comprises:

a plurality of lateral orifices communicating to said frangible seal, said orifices being spaced to disperse outwardly flowing fluids, whereby said main charge can be ignited over a relatively large area.

3. In a primer device according to claim 2, wherein said valve means comprises:

a valve member mounted within said central chamber; and a yieldable means for urging said valve member against said inlet port.

4. In a primer device according to claim 3, wherein said inlet port has a valve seat shaped to sealingly engage said valve member, said central chamber having at its junction with said valve seat an annular recess sized to permit fluid flow around said valve member and through said chamber when said valve member is retracted from said valve seat, whereby fluid velocity is made relatively uniform.

5. In a primer device according to claim 4, wherein said housing comprises:

a main frame having said central chamber and outlet port, said valve seat comprising:

an annular insert detachably mounted within said main frame, said valve means and frangible seal being sized to be removable after detachment of said annular insert.

6. In a primer device according to claim 5, wherein said main frame is detachably mountable over said cavity containing said primary propellant, said frangible seal having a central threaded blind hole facing said annular insert.

7. In a primer device according to claim 5, wherein said main frame has formed in it a receptacle contiguous to said outlet port, said receptacle being sized and aligned with respect to said frangible seal and said outlet port to capture a fragment expelled from said seal and prevent clogging of said outlet port.

8. In a primer device according to claim 7, wherein said valve member comprises:

fluted column capped by a frustro-conical element having a smaller outside diameter.

9. In a primer device according to claim 8, wherein said yieldable means comprises:

a helical compression spring.

10. In a primer device according to claim 4, wherein said frangible seal comprises:

a disc having an annular score at a depth sufficient to cause breakage thereat in response to said predetermined differential pressure.

11. In a primer device according to claim 10, wherein said housing tapers inwardly in a direction from said inlet to said outlet port, said taper being dimensioned to distribute uniformly stress applied to the surface of said housing.

12. In a primer device according to claims 1, 2, 3, 4, 10 or 11, wherein said frangible seal is a disc having a flat side facing said valve means and an opposite side having a central dome-shaped portion, said flat side having a central threaded blind hole.

13. In a primer device according to claim 11, wherein said plurality of lateral orifices are evenly spaced radial passages that are orthogonal to the axis of said housing.

14. In a primer device according to claim 11, wherein said main charge is liquid propellant.

* * * * *